US012667753B1

(12) United States Patent
Zhan

(10) Patent No.: US 12,667,753 B1
(45) **Date of Patent: *Jun. 30, 2026**

(54) FOLDING FITNESS MAT

(71) Applicant: OGOGO INC, Spokane, WA (US)

(72) Inventor: KaiGang Zhan, Ningbo (CN)

(73) Assignee: OGOGO INC

( * ) Notice: Subject to any disclaimer, the term of this patent is extended or adjusted under 35 U.S.C. 154(b) by 0 days.

This patent is subject to a terminal disclaimer.

(21) Appl. No.: 19/360,415

(22) Filed: Oct. 16, 2025

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ... A63B 21/4037; A63B 2210/50; A63B 6/00; A47G 9/062; A47G 27/0212; A47G 27/0231; Y10T 428/2457
USPC ..... 428/167
See application file for complete search history.

(56) References Cited

U.S. PATENT DOCUMENTS 7,207,932 B1 4/2007 Dean
12,214,247 B2 2/2025 Epstein et al.
12,427,367 B1 * 9/2025 Zhan ..... A63B 21/4037
2012/0053029 A1 3/2012 Newburger et al.
2025/0108251 A1 4/2025 Epstein et al.

* cited by examiner

*Primary Examiner* — Catherine A. Simone
(74) *Attorney, Agent, or Firm* — Ying-Ting Chen

(57) ABSTRACT

The present disclosure relates to a folding fitness mat, including a top surface and a bottom surface opposite to each other, where the top surface is provided with one or more top surface broken line grooves spanning a width direction of the fitness mat, the bottom surface is provided with one or more bottom surface broken line grooves extending along the width direction of the fitness mat, bump structures are respectively disposed at two opposite ends of each bottom surface broken line groove, each of the bump structures is connected to groove walls on two sides in a width direction of each of the bottom surface broken line grooves, and the bump structures can reinforce the strength of the bottom surface broken line groove to prevent tearing. In a length direction of the folding fitness mat, the top surface broken line grooves and the bottom surface broken line grooves are arranged at intervals and in a staggered manner, allowing a user to cross-fold the folding fitness mat along the top broken line grooves and the bottom broken line grooves, and to store the folding fitness mat into a small block for easy storage and carrying.

18 Claims, 11 Drawing Sheets

FOLDING FITNESS MAT

TECHNICAL FIELD

The present disclosure relates to the field of household supplies, in particular to a folding fitness mat.

BACKGROUND

As everyone knows, a soft mat is a common household article for leaning, and people can lie, recline, or sit on it for rest or yoga fitness without making direct contact with the ground. Currently, most soft mats on the market are rolled or folded to reduce their volume for storage. However, during folding for storage, repeated folding and unfolding at the same position of the soft mat makes it prone to breakage there.

SUMMARY

The present disclosure aims to provide a folding fitness mat, to solve the technical problem that the soft mat that can be folded for storage is prone to breakage at the folding position during repeated folding and unfolding.

To solve the above technical problems, the present disclosure adopts the following technical solution:

The present disclosure provides a folding fitness mat, including a top surface and a bottom surface opposite to each other, where the top surface is provided with one or more top surface broken line grooves spanning a width direction of the fitness mat, the bottom surface is provided with one or more bottom surface broken line grooves extending along the width direction of the fitness mat, bump structures are respectively disposed at two opposite ends of each of the bottom surface broken line grooves, each of the bump structures is connected to groove walls on two sides in a width direction of each of the bottom surface broken line grooves, and in a length direction of the folding fitness mat, the top surface broken line grooves and the bottom surface broken line grooves are arranged at intervals and in a staggered manner.

In one embodiment, a distance between any adjacent top surface broken line groove and bottom surface broken line groove in the length direction of the folding fitness mat is equal.

In one embodiment, in a thickness direction of the folding fitness mat, an end surface of each of the bump structures close to the bottom surface is recessed to form an arc-shaped end surface, and the bump structures do not protrude from the bottom surface.

In one embodiment, a surface of the top surface is set as a smooth surface that has no rough feeling when in contact with the skin.

In one embodiment, a surface of the bottom surface is provided with protruding textures that increase a frictional force.

In one embodiment, an inner side of each of the bump structures is smoothly connected to an inner wall surface of each of the bottom surface broken line grooves to form an arc-shaped chamfered angle.

In one embodiment, the groove walls on the two sides in the width direction of each of the bottom surface broken line grooves are smoothly connected to the bottom surface to form an arc-shaped chamfered angle.

In one embodiment, groove walls on two sides in a width direction of each of the top surface broken line grooves are smoothly connected to the top surface to form an arc-shaped chamfered angle.

In one embodiment, a width of a notch of each of the top surface broken line grooves is greater than a width of a groove bottom wall of each of the top surface broken line grooves.

In one embodiment, a width of a notch of each of the bottom surface broken line grooves is greater than a width of a groove bottom wall of each of the bottom surface broken line grooves.

In one embodiment, a mat body of the folding fitness mat is composed of foamed material layers made of a single material, and each of the foamed material layers includes any one of polyethylene (PE), cross-linked polyethylene (XPE), irradiated cross-linked polyethylene (IXPE), ethylene vinyl acetate (EVA), thermoplastic elastomer (TPE), or polyolefin elastomer (POE).

In one embodiment, the number of the foamed material layers is a plurality, and the plurality of foamed material layers are sequentially stacked to form the mat body of the folding fitness mat.

In one embodiment, the foamed material layers on the folding fitness mat have elasticity.

In one embodiment, thicknesses of the top surface and the bottom surface of the folding fitness mat are both not less than 5 mm.

In one embodiment, a surface of the top surface is provided with first magnets, and the number of the first magnets is n+1, where n is the number of the top surface broken line grooves.

In one embodiment, the first magnets are linearly arranged on the surface of the top surface, and two adjacent ones of the first magnets are respectively located on two sides of each of the top surface broken line grooves and are spaced equidistantly from each of the top surface broken line grooves, where the two adjacent ones of the first magnets are capable of being magnetically connected to each other.

In one embodiment, a surface of the bottom surface is provided with second magnets, and the number of the second magnets is n+1, where n is the number of the bottom surface broken line grooves.

In one embodiment, the second magnets are linearly arranged on the surface of the bottom surface, and two adjacent ones of the second magnets are respectively located on two sides of each of the bottom surface broken line grooves and are spaced equidistantly from each of the bottom surface broken line grooves, where the two adjacent ones of the second magnets are capable of being magnetically connected to each other.

In one embodiment, an end in the length direction of the folding fitness mat is connected to a binding strap via fasteners, an outer side surface of one end of the binding strap close to the folding fitness mat is provided with a hook-and-loop fastener loop surface, and an inner side surface of one end of the binding strap away from the folding fitness mat is provided with a hook-and-loop fastener hook surface.

In one embodiment, a carrying strap is disposed on a side wall on one side in the length direction of the folding fitness mat.

It can be seen from the above technical solution that the embodiment of the present disclosure has at least the following advantages and positive effects:

According to the folding fitness mat provided in the embodiment of the present disclosure, the top surface and the bottom surface are provided with the top surface broken line grooves and the bottom surface broken line grooves arranged at intervals and in a staggered manner, respectively, enabling a user to easily fold the folding fitness mat for storage. In addition, the bump structures are disposed at two ends along a length extension direction of each bottom surface broken line groove, and the two ends of each bump structure are connected to the groove walls on the two sides in the width direction of the corresponding broken line groove to enhance the connecting strength of each portion of the mat body of the folding fitness mat at the broken line grooves, thereby preventing the folding fitness mat from being easily torn and damaged at the broken line grooves during repeated folding for storage by the user, and extending the service life of the entire folding fitness mat; and four corners of the top surface are all provided with arc-shaped chamfered angles, which can avoid formation of sharp corner angles and enhance sense of beauty.

According to the folding fitness mat provided in the embodiment of the present disclosure, the folding fitness mat in a folded state can be bound by the binding strap, such that the folding fitness mat will not be unfolded when carried or transferred by the user and can remain folded during storage and when used as a seat cushion by the user; moreover, the binding strap is detachable and can be used as needed by the user; furthermore, when the folding fitness mat is in the folded state, two overlapping top surfaces or two overlapping bottom surfaces can be magnetically connected by magnets, such that the folding fitness mat will not be unfolded freely when not bound by the binding strap, thereby enabling the user to easily fold and transfer the folding fitness mat without compromising its overall appearance.

BRIEF DESCRIPTION OF THE DRAWINGS

To more clearly illustrate the technical solutions in the embodiments of the present disclosure or in the prior art, the accompanying drawings that need to be used in the description of the embodiments or the prior art will be briefly introduced below. Apparently, the accompanying drawings in the description below merely illustrate some embodiments of the present disclosure. Those of ordinary skill in the art may also derive other accompanying drawings from these accompanying drawings without creative efforts.

Figure 1:
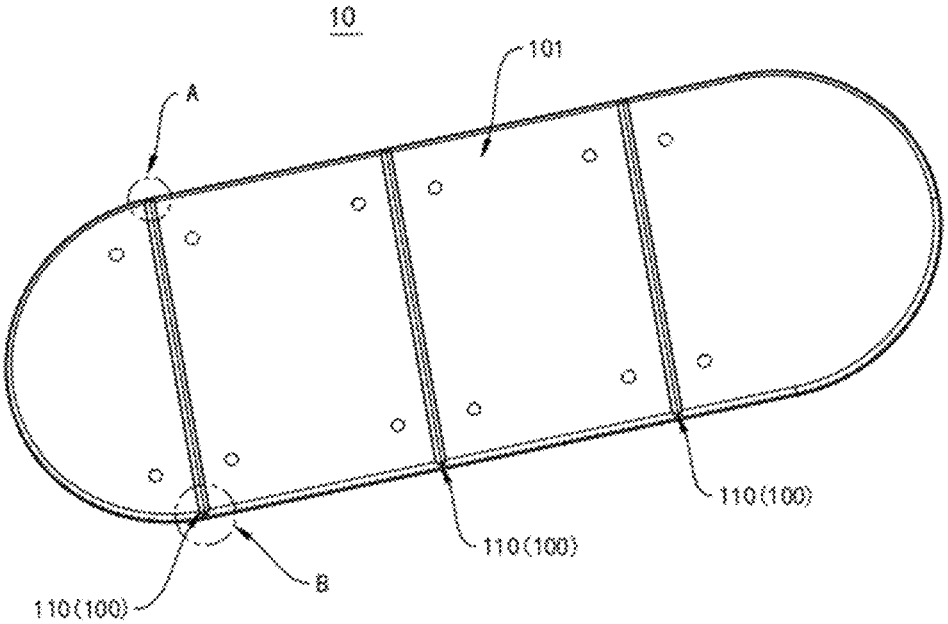
FIG. 1 is a schematic diagram of an overall structure of a folding fitness mat in an embodiment of the present disclosure.

The description of reference numerals is as follows:

10: folding fitness mat; 101: top surface; 102: bottom surface; 100: broken line groove; 110: top surface broken line groove; 120: bottom surface broken line groove; 200: bump structure; 210: arc-shaped end surface; 300: foamed material layer; 400: protective cover; 500: protruding texture; 600: binding strap; 701: hook-and-loop fastener loop surface; 702: hook-and-loop fastener hook surface; 703: first magnet; 704: second magnet; 800: carrying strap; and 900: fastener.

DETAILED DESCRIPTION OF THE EMBODIMENTS

Typical embodiments that embody the features and advantages of the present disclosure will be described in detail in the following description. It should be understood that the present disclosure can have various changes in different embodiments without departing from the scope of the present disclosure, and the description and drawings therein are essentially for illustrative purposes and not intended to limit the present disclosure.

Furthermore, the terms "first" and "second" are only for descriptive purposes, and cannot be construed as indicating or implying relative importance or implying the number of technical features indicated. Thus, the features defined with "first" and "second" may explicitly or implicitly include one or more of the features. In the description of the present disclosure, "a plurality of" means two or more, unless otherwise expressly and specifically defined.

In the description of the present disclosure, it is to be noted that the terms "dispose", "connected", and "connection" should be understood in a broad sense, unless otherwise expressly specified and limited. For example, it may be a fixed connection, a detachable connection, or an integrated connection; it may be a mechanical connection or an electrical connection; and it may be being directly connected, being indirectly connected via an intermediate medium, or a communication between interiors of two elements. Those of ordinary skill in the art can understand specific meanings of the above terms in the present disclosure based on specific circumstances.

Referring to FIG. 1 to FIG. 14, the present disclosure provides a novel folding fitness mat 10. The folding fitness mat 10 is provided with a plurality of broken line grooves 100 to facilitate a user in folding the folding fitness mat 10 at the broken line grooves 100, such that the entire folding fitness mat 10 can be switched between an unfolded state and a stored state. The folding fitness mat 10 has a very large flat area in the unfolded state, such that the user can lie or recline on it for rest or fitness exercises such as yoga and aerobics. The folding fitness mat 10 doubles in thickness after being folded and stored, making it versatile. It can be used not only as a fitness seat cushion or a yoga kneeler, but also as a garden kneeler, an outdoor seat cushion, a kitchen mat, and in various other application scenarios. This achieves a lifestyle of one mat having multiple purposes. Besides, the folding fitness mat 10 becomes a small block after being folded, such that it is convenient to carry, and storage time is saved. The user can fold and store it in a bag when not using the folding fitness mat 10.

Referring to FIG. 1 to FIG. 9, the folding fitness mat 10 includes a top surface 101 and a bottom surface 102 opposite to each other along its thickness. The top surface 101 is provided with top surface broken line grooves 110. The bottom surface 102 is provided with bottom surface broken line grooves 120. In a length extension direction of the folding fitness mat 10, the top surface broken line grooves 110 and the bottom surface broken line grooves 120 are arranged at intervals and in a staggered manner. The top surface broken line grooves 110 and the bottom surface broken line grooves 120 are open in opposite directions along a thickness direction of the folding fitness mat 10. Length extension directions of the top surface broken line grooves 110 and the bottom surface broken line grooves 120 are parallel to each other and are both parallel to a width extension direction of the folding fitness mat 10.

Figure 2:
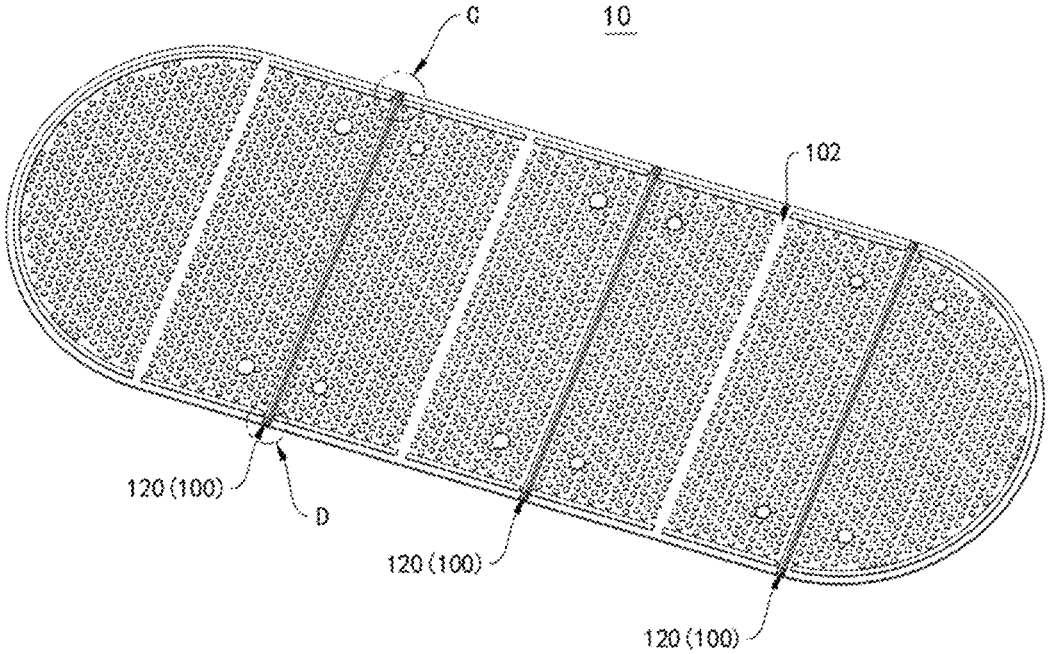
FIG. 2 is a schematic diagram of an overall structure of the folding fitness mat as shown in FIG. 1 from a bottom view.
Figure 3:
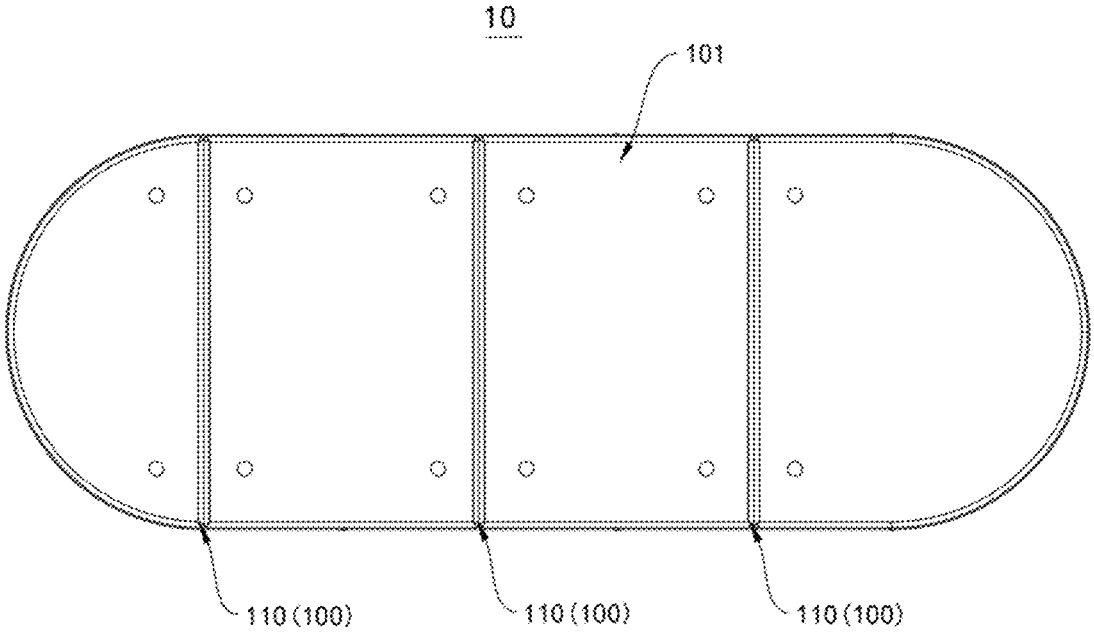
FIG. 3 is a top view of the folding fitness mat as shown in FIG. 1.
Figure 4:
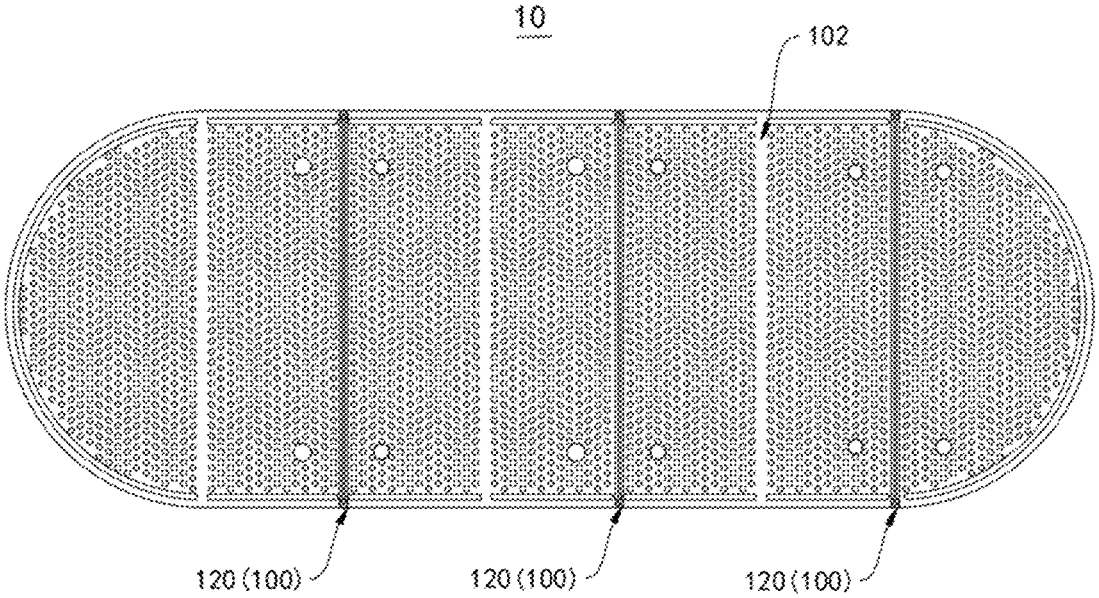
FIG. 4 is a bottom view of the folding fitness mat as shown in FIG. 1.
Figure 5:
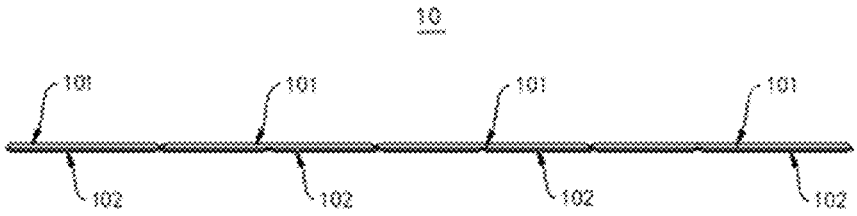
FIG. 5 is a front view of the folding fitness mat as shown in FIG. 1.
Figure 10:
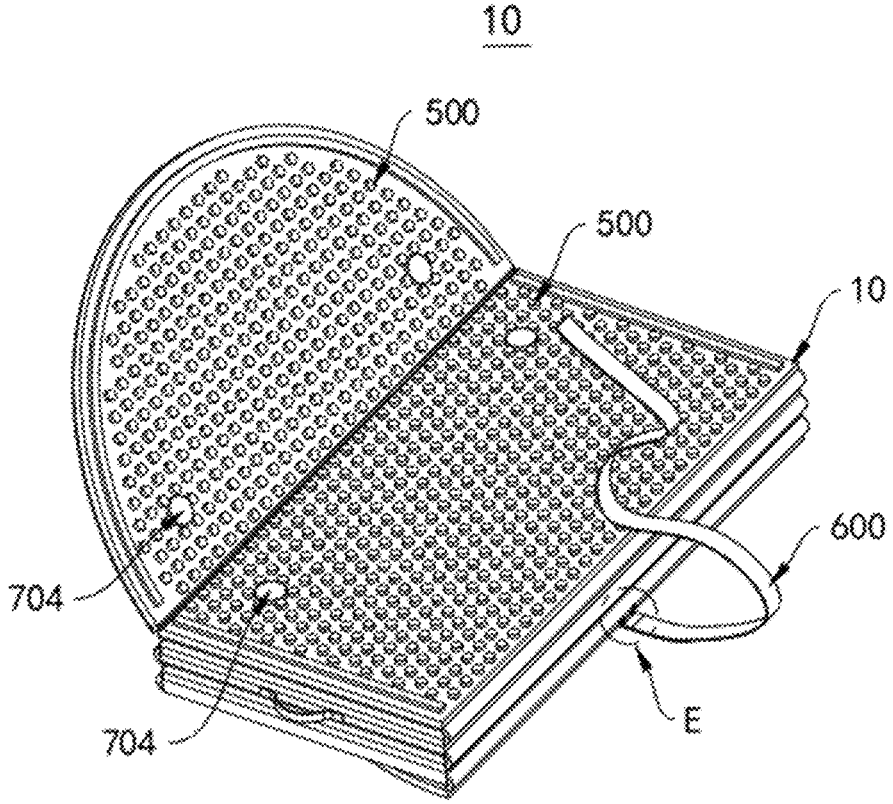
FIG. 10 is a schematic diagram of a part of a top surface of the folding fitness mat unfolded in FIG. 1.

Referring to FIG. 1, FIG. 2, and FIG. 10, four corners of the top surface 101 are all provided with arc-shaped chamfered angles to avoid formation of sharp corner angles that affect user experience, and to enhance sense of beauty.

Figure 6:
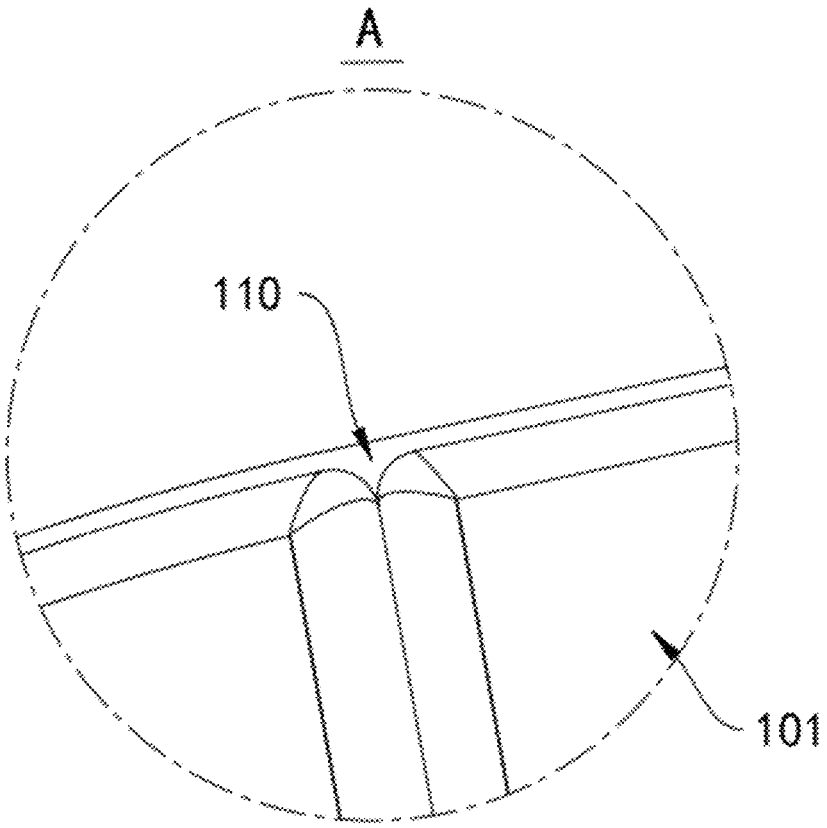
FIG. 6 is a schematic diagram of an enlarged structure at A shown in FIG. 1.
Figure 7:
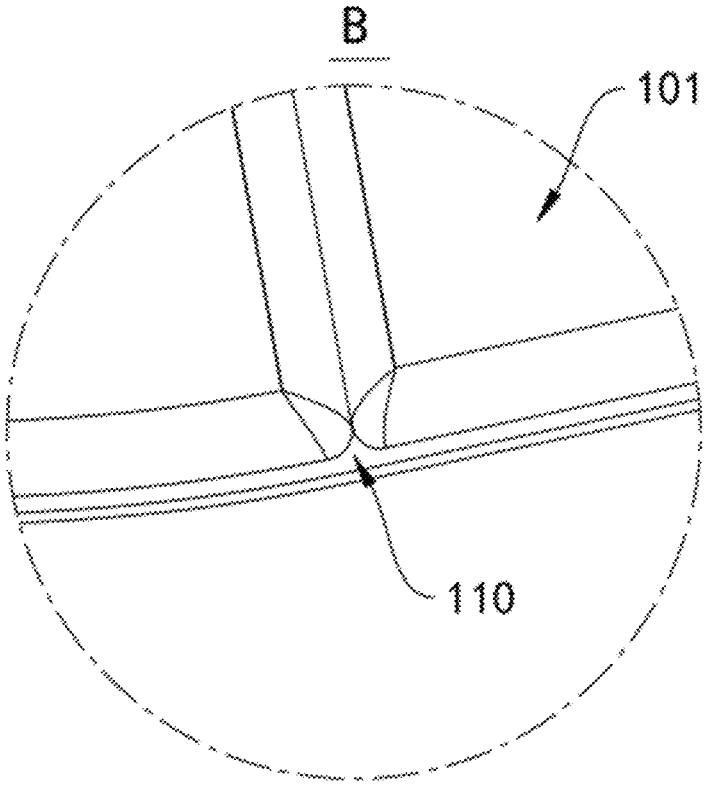
FIG. 7 is a schematic diagram of an enlarged structure at B shown in FIG. 1.

Referring to FIG. 1, FIG. 6, and FIG. 7, in which FIG. 6 and FIG. 7 are partial enlarged views of a top surface broken line groove 110, groove walls on two sides in a width direction of each of the top surface broken line grooves 110 are smoothly connected to the top surface 101 to form an arc-shaped chamfered angle. The design of the arc-shaped chamfered angle is more conducive to folding the folding fitness mat 10 at the top surface broken line grooves 110.

Figure 8:
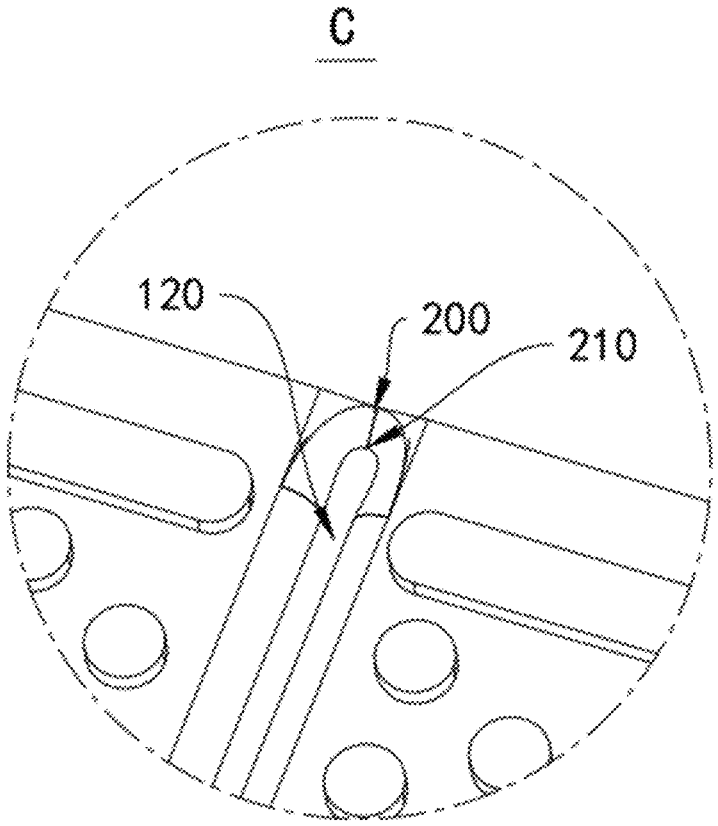
FIG. 8 is a schematic diagram of an enlarged structure at C shown in FIG. 1.
Figure 9:
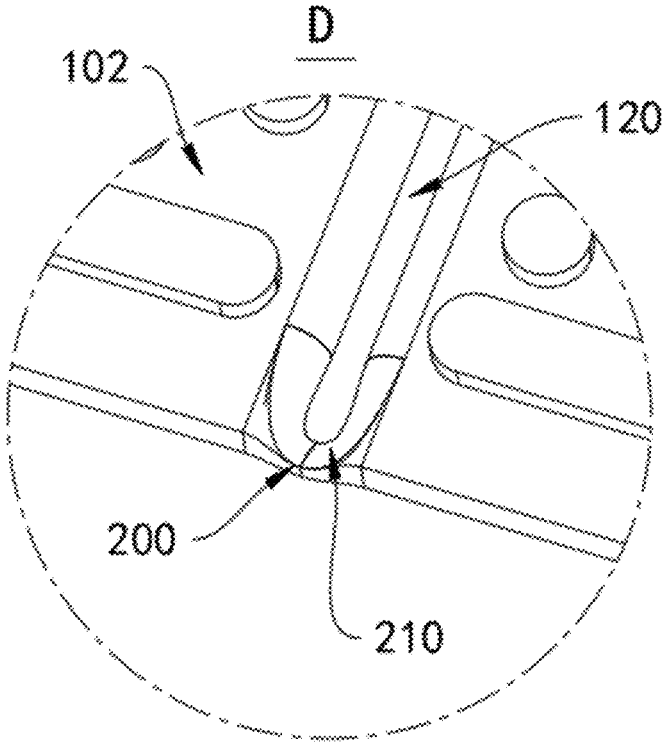
FIG. 9 is a schematic diagram of an enlarged structure at D shown in FIG. 1.

Referring to FIG. 2, FIG. 8, and FIG. 9, in which FIG. 8 and FIG. 9 are partial enlarged views of a bottom surface broken line groove 120, ends of the bottom surface broken line groove 120 along the length extension direction of the bottom surface broken line groove are provided with bump structures 200, and two ends of the bump structure 200 are respectively connected to groove walls on two opposite sides of the corresponding broken line groove 100 (the top surface broken line groove 110 or the bottom surface broken line groove 120) along its width direction, thereby enhancing the connecting strength of the ends of the broken line groove 100, and preventing the folding fitness mat 10 from being torn.

In this embodiment, the bump structures 200 are disposed at two opposite ends of the bottom surface broken line groove 120 along the length extension direction of the bottom surface broken line groove, and the top surface broken line groove 110 is not provided with the bump structures 200. The top surface broken line groove 110 facilitates folding of the folding fitness mat 10. The bottom surface broken line groove 120 enhances the connecting strength of the folding fitness mat 10, and prevents tearing and damage. It should be understood that, in other embodiments, the bump structures 200 may be disposed only at the top surface broken line groove 110, or when the smoothness of folding is not considered, the bump structures 200 may be disposed at the ends of both the top surface broken line groove 110 and the bottom surface broken line groove 120. In the present disclosure, the arrangement position of the bump structures 200 is not limited, as long as the bump structures are disposed at the ends of the broken line groove 100 to enhance the connecting strength.

In an embodiment, referring to FIGS. 1 to 4, the number of top surface broken line grooves 110 and the number of bottom surface broken line grooves 120 are plural and they are evenly arranged. A distance between any adjacent top surface broken line groove 110 and bottom surface broken line groove 120 along the length extension direction of the folding fitness mat 10 is equal, such that the entire folding fitness mat 10 is neat and compact when folded. It should be understood that, without considering the neatness of storage of the folding fitness mat 10, the number of the top surface broken line grooves 110, the number of the bottom surface broken line grooves 120, and the distance between any adjacent top surface broken line groove and bottom surface broken line groove are not limited.

Figure 13:
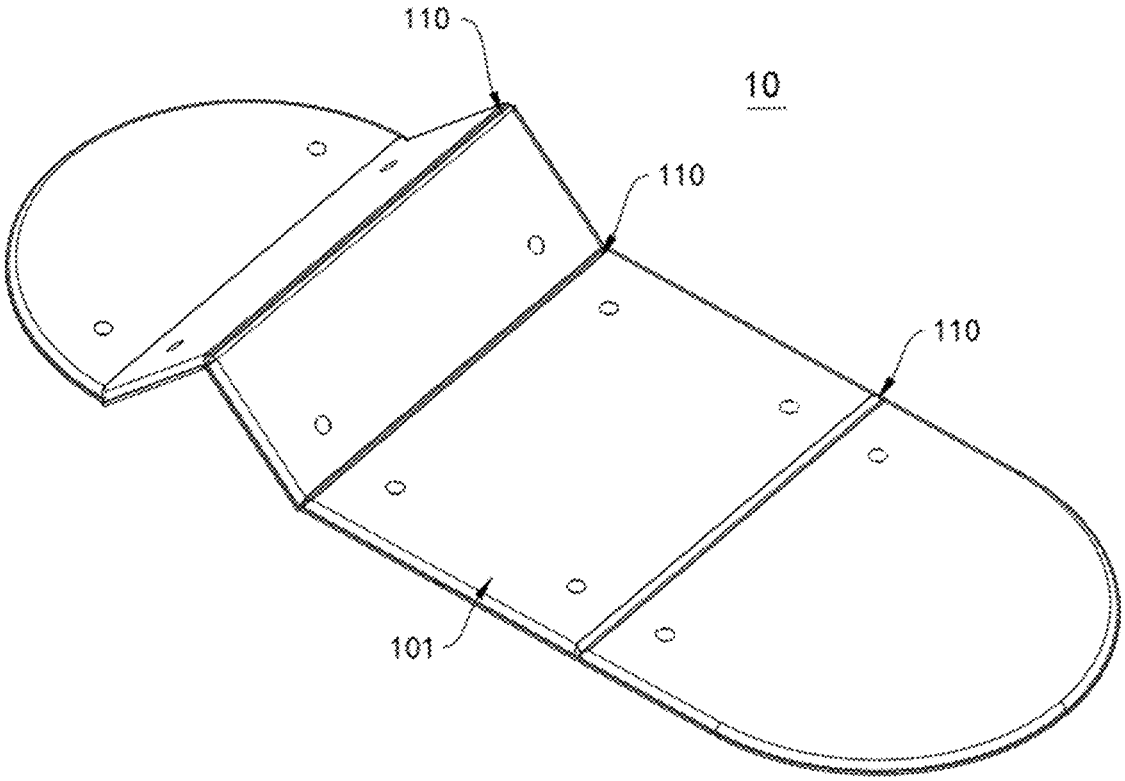
FIG. 13 is another state diagram of the folding fitness mat in FIG. 1.

In an embodiment, referring to FIG. 13 and FIG. 9, in a thickness direction of the folding fitness mat 10, an end surface of each of the bump structures 200 close to the bottom surface 102 is recessed to form an arc-shaped end surface 210, and the bump structures 200 do not protrude from the bottom surface 102. Herein, the design of the arc-shaped end surface 210 is more conducive to folding the folding fitness mat 10 at the bottom surface broken line groove 120, and the bump structures 200 do not protrude from the bottom surface 102, thereby improving the compactness of storage of the folding fitness mat 10. It should be understood that, in the present disclosure, without considering the benefits of folding and compact storage, the shape of the bump structures 200 is not limited, as long as the bump structures can be connected to an inner side wall of the bottom surface broken line groove 120.

In an embodiment, referring to FIG. 13 and FIG. 9, an inner side of each of the bump structures 200 is smoothly connected to an inner wall surface (including a groove bottom wall and a groove side wall) of the bottom surface broken line groove 120 to form an arc-shaped chamfered angle. Such a design further increases the connecting strength of the bump structures 200 at the ends of the bottom surface broken line groove 120. It should be understood that, in the present disclosure, whether the inner side of each of the bump structures 200 is smoothly connected to the inner wall surface of the bottom surface broken line groove 120 is not limited on the premise that the connecting strength of the bump structures 200 is sufficiently high.

In an embodiment, groove walls on two sides in a width direction of each of the bottom surface broken line grooves 120 are smoothly connected to the bottom surface 102 to form an arc-shaped chamfered angle. The design of the arc-shaped chamfered angle is more conducive to folding the folding fitness mat 10 at the bottom surface broken line groove 120.

Herein, it is noteworthy that the configuration of the top surface broken line grooves 110 and the bottom surface broken line grooves 120 enables the entire folding fitness mat 10 to be folded freely in an alternating front-to-back manner at the broken line grooves 100.

In an embodiment, referring to FIG. 6 to FIG. 9, a width of a notch of the top surface broken line groove 110 is greater than a width of a groove bottom wall of the top surface broken line groove 110, and a width of a notch of the bottom surface broken line groove 120 is greater than a width of a groove bottom wall of the bottom surface broken line groove 120, that is, both the top surface broken line groove 110 and the bottom surface broken line groove 120 are wide at the top and narrow at the bottom. Meanwhile, a side wall region of the top surface broken line groove 110 transitions in an arc shape from the notch to the groove bottom. Such a design provides a folding gap for the entire folding fitness mat 10 to prevent wear between two mat bodies at the top surface broken line groove 110 or the bottom surface broken line groove 120. Additionally, due to the design of wide top, narrow bottom, and arc-shaped transition, during unfolding and folding of the folding fitness mat 10, the two opposite inner side walls of the top surface broken line groove 110 or the bottom surface broken line groove 120 will not come into mutual contact and wear, or will make slight contact with each other to reduce wear. It should be understood that the width of the top surface broken line groove 110 or the bottom surface broken line groove 120 is not limited on the premise of not considering the wear.

In an embodiment, a mat body of the folding fitness mat 10 is composed of foamed material layers 300, and a foamed material includes any one or a mixture of PE, XPE, IXPE, EVA, TPE, or POE. It should be noted that PE, XPE, IXPE, EVA, TPE, or POE is an elastic foamed material (with the foaming ratio being twice or higher), is a closed-hole foamed material, and has excellent impact resistance, rebounding performance, flexibility, sound insulation, heat insulation, waterproofness, and non-toxic and environmental protection functions. Since the foamed material layers 300 on the folding fitness mat 10 are made of an elastic foamed material, the foamed material layers 300 on the folding fitness mat 10 have elasticity. When the user performs fitness movements on the folding fitness mat 10, effective cushioning can be formed when the user is in contact with the ground. The above elastic foamed materials can improve the comfort level of the user lying, reclining or sitting on the folding fitness mat 10. It should be understood that on the premise of not considering the comfort level, the material of the mat body of the folding fitness mat 10 in the present disclosure is not limited.

In an embodiment, a surface of the top surface is set as a smooth surface that has no rough feeling when in contact with the skin, such that when the user performs fitness movements on the unfolded folding fitness mat 10, a frictional force between the folding fitness mat 10 and the user is reduced, and the comfort during use is improved.

Figure 11:
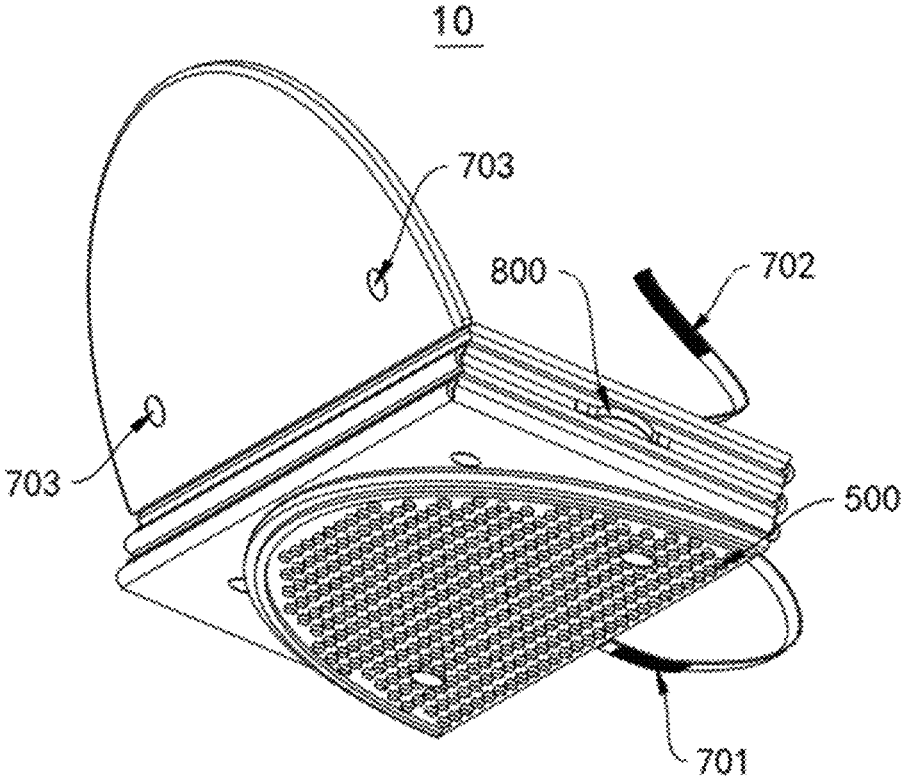
FIG. 11 is a bottom view of the folding fitness mat in FIG. 10.

Referring to FIG. 11, when the user performs fitness movements, the movements will affect the folding fitness mat 10. To prevent the folding fitness mat 10 from moving due to changes in movement amplitude of the user, protruding textures 500 that increase a frictional force are disposed on a surface of the bottom surface, thereby increasing the frictional force between the folding fitness mat and the ground, and enhancing the stability of the folding fitness mat 10 during use.

To ensure the comfort of the folding fitness mat 10, during manufacturing of the foamed material layers 300 of the folding fitness mat 10, thicknesses of the top surface and the bottom surface of the folding fitness mat are both not less than 5 mm.

Figure 14:
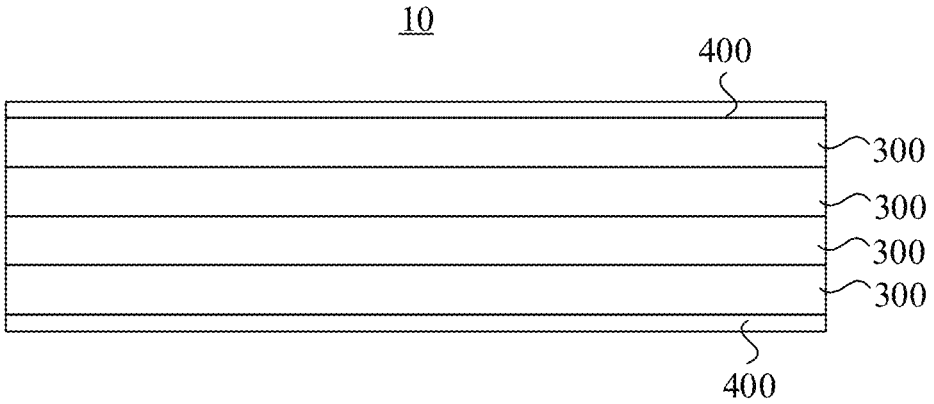
FIG. 14 is a schematic structural diagram of material layers of a folding fitness mat.

In an embodiment, referring to FIG. 14, the number of the foamed material layers 300 is a plurality, and the plurality of foamed material layers 300 are sequentially stacked to form the mat body of the folding fitness mat 10. The colors of the foamed material layers 300 here can be the same or different. It should be understood that in the present disclosure, the number of the foamed material layers 300 is not limited.

A production technology for single-layer mats includes foaming the raw material such as PE, EVA, TPE or POE into a large elastic body, cutting the foamed material into thin sheets after cooling same, then heating and softening the thin sheets of the foamed material, finally placing the heated and softened foamed materials into two cooled molds, performing cold-press molding under the pressure of a machine, and then cutting the foamed materials into finished products by means of a cutting die after molding.

A production technology for multi-layer mats includes foaming the raw material such as PE, EVA, TPE or POE into a large elastic body, cutting the foamed material into thin sheets after cooling same, performing various multi-layer compounding on the foamed materials cut thin, then heating and softening the compound materials, finally placing the heated and softened foamed materials into two cooled molds, performing cold-press molding under the pressure of a machine, and then cutting the foamed materials into finished products by means of a cutting die after molding.

In an embodiment, referring to FIG. 14, in this embodiment, the folding fitness mat 10 further includes protective covers 400, where the protective covers 400 cover outer surfaces of the foamed material layers 300 to protect the foamed material layers 300 against corrosion by an external environment; and on the other hand, the protective covers can compact and compress the foamed materials, thereby enhancing the folding fitness mat 10. The protective covers 400 here are made of three-proofing fabric or leather, which has three major functions of fouling prevention, oil prevention and water prevention, such that an outer surface of the folding fitness mat 10 can be kept clean easily, and the use comfort level and the cleanliness of the user can be improved. It should be understood that in the present disclosure, whether the protective covers 400 are configured and the material of the protective covers 400 are not limited.

Besides, the production and processing processes for single-layer mats and multi-layer mats in the embodiments of the present disclosure are briefly introduced, and the mats here refer to the foregoing foamed material layers 300.

According to the folding fitness mat 10 provided in the embodiment of the present disclosure, the top surface 101 and the bottom surface 102 are provided with the top surface broken line grooves 110 and the bottom surface broken line grooves 120 arranged at intervals and in a staggered manner, respectively, enabling the user to easily fold the folding fitness mat 10 for storage. In addition, the bump structures 200 are disposed at the ends along the length extension direction of at least one of the top surface broken line groove 110 and the bottom surface broken line groove 120, and the two ends of each bump structure 200 are connected to the groove walls on the two sides in the width direction of the corresponding broken line groove 100 to enhance the connecting strength of each portion of the mat body of the folding fitness mat 10 at the broken line grooves 100, thereby preventing the folding fitness mat 10 from being easily torn and damaged at the broken line grooves 100 during repeated folding for storage by the user, and extending the service life of the entire folding fitness mat 10.

Referring to FIG. 10 to FIG. 13, first magnets 703 are disposed on the surface of the top surface, and the number of the first magnets 703 is n+1, where n is the number of the top surface broken line grooves. The first magnets 703 are linearly arranged on the surface of the top surface, and two adjacent first magnets 703 are respectively located on two sides of the top surface broken line groove and are spaced equidistantly from the top surface broken line groove, wherein the two adjacent first magnets 703 can be magnetically connected to each other, thereby ensuring that when the folding fitness mat 10 is folded, two opposite top surfaces each have corresponding first magnets 703. Second magnets 704 are disposed on the surface of the bottom surface, and the number of the second magnets 704 is n+1, where n is the number of the bottom surface broken line grooves. The second magnets 704 are linearly arranged on the surface of the bottom surface, and two adjacent second magnets 704 are respectively located on two sides of the bottom surface broken line groove and are spaced equidistantly from the bottom surface broken line groove, where the two adjacent second magnets 704 can be magnetically connected to each other, thereby ensuring that when the folding fitness mat 10 is folded, two opposite bottom surfaces each have corresponding second magnets 704. To ensure the overall comfort of the folding fitness mat 10, the aforementioned first magnets 703 and second magnets 704 may be selected from flexible magnets, without limitation.

The first magnets 703 and the second magnets 704 are embedded in the top surface and the bottom surface, respectively, and magnetic attraction surfaces of the first magnets 703 and magnetic attraction surfaces of the second magnets 704 are flush with the surface of the top surface and the surface of the bottom surface, respectively. When the user is on the unfolded folding fitness mat 10, the first magnets 703 are flush with the surface of the top surface, such that when the user performs fitness movements on the unfolded folding fitness mat 10, the obstruction caused by the first magnets 703 on the top surface of the folding fitness mat 10 to the user is reduced, thereby improving the comfort of use.

When the folding fitness mat 10 is in the folded state, two overlapping top surfaces or two overlapping bottom surfaces can be magnetically connected by magnets, such that the folding fitness mat 10 will not be unfolded freely when not bound by the binding strap 600, thereby enabling the user to easily fold and transfer the folding fitness mat 10 without compromising its overall appearance.

An end in the length direction of the folding fitness mat 10 is connected to a binding strap 600 via fasteners 900. Since the fasteners 900 are disposed at the end of the folding fitness mat 10, when the user is on the unfolded folding fitness mat 10, the user will not be affected by the fasteners 900 and will not feel hardness and discomfort caused by the fasteners 900. The fasteners 900 may be selected from existing and commonly used fastener structures that allow for easy detachment, such as elastic fasteners, snap fasteners, or plug-in fasteners, as needed without limitation. When the fasteners 900 are applied to the folding fitness mat 10, two movably snap-fit parts of each fastener 900 are separated and respectively connected to the body of the folding fitness mat 10 and the binding strap 600. The connection method may be selected from adhesive bonding or sewing, without limitation.

Figure 12:
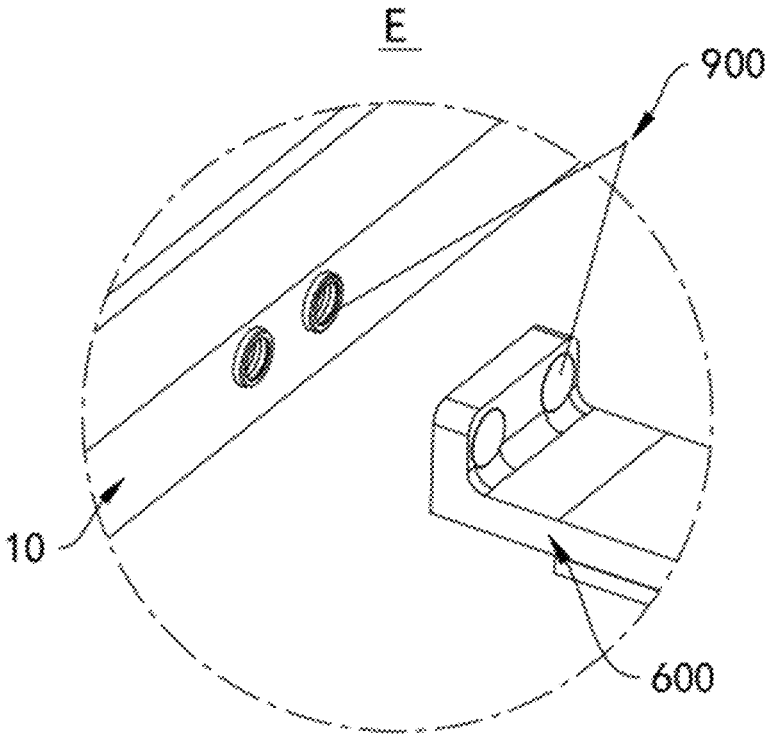
FIG. 12 is a schematic diagram of an enlarged structure at E shown in FIG. 11.

Referring to FIG. 11 and FIG. 12, an outer side surface of one end of the binding strap 600 close to the folding fitness mat 10 is provided with a hook-and-loop fastener loop surface 701, and an inner side surface of one end of the binding strap 600 away from the folding fitness mat 10 is provided with a hook-and-loop fastener hook surface 702. When the folding fitness mat 10 is in the folded state, one end of the binding strap 600 is wound around the folding fitness mat 10 for one circle and then connected to the other end of the binding strap 600. Then, the hook-and-loop fastener hook surface 702 on the side surface of the binding strap 600 is brought into contact with the hook-and-loop fastener loop surface 701 on the other side surface of the binding strap 600, and the hook-and-loop fastener hook surface 702 hooks onto the hook-and-loop fastener loop surface 701. At this time, the binding strap 600 forms a stable closed loop and binds the entire folding fitness mat 10 in the loop. Moreover, the smaller the area in the loop is, the greater the binding force exerted on the folding fitness mat 10 is, enabling the various foamed material layers 300 of the folding fitness mat 10 to make close contact.

The folding fitness mat 10 in a folded state can be bound by the binding strap 600, such that the folding fitness mat 10 will not be unfolded when carried or transferred by the user and can remain folded during storage and when used as a seat cushion by the user; moreover, the binding strap 600 is detachable and can be used as needed by the user.

When the folding fitness mat 10 is in the folded state and bound by the binding strap 600, a carrying strap 800 is disposed on a side wall on one side in the length direction of the folding fitness mat 10 to facilitate carrying and transfer of the folding fitness mat 10, such that the user can easily lift and move the folding fitness mat 10. Since the carrying strap 800 is of a flexible structure, the overall elasticity and comfort of the folding fitness mat 10 are not affected.

While the present disclosure has been described with reference to several typical embodiments, it should be understood that the terms used are illustrative and exemplary, but not limiting. As the present disclosure can be embodied in various forms without departing from the spirit or essence of the disclosure, it should be understood that the above embodiments are not limited to any of the aforementioned details, but should be broadly interpreted within the spirit and scope defined by the appended claims. Therefore, all changes and modifications falling within the scope of claims or their equivalents should be covered by the appended claims.

What is claimed is:

1. A folding fitness mat, comprising a top surface and a bottom surface opposite to each other, wherein the top surface is provided with one or more top surface broken line grooves spanning a width direction of the folding fitness mat, the bottom surface is provided with one or more bottom surface broken line grooves extending along the width direction of the folding fitness mat, bump structures are respectively disposed at two opposite ends of each of the bottom surface broken line grooves, each of the bump structures is connected to groove walls on two sides in a width direction of each of the bottom surface broken line grooves, and in a length direction of the folding fitness mat, the top surface broken line grooves and the bottom surface broken line grooves are arranged at intervals and in a staggered manner, a surface of the bottom surface is provided with protruding textures that increase a frictional force.

2. The folding fitness mat according to claim 1, wherein a distance between any adjacent top surface broken line groove and bottom surface broken line groove in the length direction of the folding fitness mat is equal.

3. The folding fitness mat according to claim 1, wherein an inner side of each of the bump structures is smoothly connected to an inner wall surface of each of the bottom surface broken line grooves to form an arc-shaped chamfered angle.

4. The folding fitness mat according to claim 1, wherein groove walls on two sides in a width direction of each of the top surface broken line grooves are smoothly connected to the top surface to form an arc-shaped chamfered angle.

5. The folding fitness mat according to claim 1, wherein a width of a notch of each of the top surface broken line grooves is greater than a width of a groove bottom wall of each of the top surface broken line grooves.

6. The folding fitness mat according to claim 1, wherein a width of a notch of each of the bottom surface broken line grooves is greater than a width of a groove bottom wall of each of the bottom surface broken line grooves.

7. The folding fitness mat according to claim 1, wherein a mat body of the folding fitness mat is composed of foamed material layers made of a single material, and each of the foamed material layers comprises any one of polyethylene (PE), cross-linked polyethylene (XPE), irradiated cross-linked polyethylene (IXPE), ethylene vinyl acetate (EVA), thermoplastic elastomer (TPE), or polyolefin elastomer (POE).

8. The folding fitness mat according to claim 7, wherein the number of the foamed material layers is a plurality, and the plurality of foamed material layers are sequentially stacked to form the mat body of the folding fitness mat.

9. The folding fitness mat according to claim 1, wherein thicknesses of the top surface and the bottom surface of the folding fitness mat are both not less than 5 mm.

10. The folding fitness mat according to claim 1, wherein a surface of the top surface is provided with first magnets, and the number of the first magnets is n+1, wherein n is the number of the top surface broken line grooves.

11. The folding fitness mat according to claim 10, wherein the first magnets are linearly arranged on the surface of the top surface, and two adjacent ones of the first magnets are respectively located on two sides of each of the top surface broken line grooves and are spaced equidistantly from each of the top surface broken line grooves, wherein the two adjacent ones of the first magnets are capable of being magnetically connected to each other.

12. The folding fitness mat according to claim 10, wherein a surface of the bottom surface is provided with second magnets, and the number of the second magnets is n+1, wherein n is the number of the bottom surface broken line grooves.

13. The folding fitness mat according to claim 12, wherein the first magnets and the second magnets are embedded in the top surface and the bottom surface, respectively, and magnetic attraction surfaces of the first magnets and magnetic attraction surfaces of the second magnets are flush with the surface of the top surface and the surface of the bottom surface, respectively.

14. The folding fitness mat according to claim 12, wherein the second magnets are linearly arranged on the surface of the bottom surface, and two adjacent ones of the second magnets are respectively located on two sides of each of the bottom surface broken line grooves and are spaced equidistantly from each of the bottom surface broken line grooves, wherein the two adjacent ones of the second magnets are capable of being magnetically connected to each other.

15. The folding fitness mat according to claim 1, wherein an end in the length direction of the folding fitness mat is connected to a binding strap via fasteners, an outer side surface of one end of the binding strap close to the folding fitness mat is provided with a hook-and-loop fastener loop surface, and an inner side surface of one end of the binding strap away from the folding fitness mat is provided with a hook-and-loop fastener hook surface.

16. The folding fitness mat according to claim 1, wherein a carrying strap is disposed on a side wall on one side in the length direction of the folding fitness mat.

17. The folding fitness mat according to claim 1, wherein in a thickness direction of the folding fitness mat, an end surface of each of the bump structures close to the bottom surface is recessed to form an arc-shaped end surface, and the bump structures do not protrude from the bottom surface.

18. The folding fitness mat according to claim 17, wherein the groove walls on the two sides in the width direction of each of the bottom surface broken line grooves are smoothly connected to the bottom surface to form an arc-shaped chamfered angle.

* * * * *